US007466085B2

(12) United States Patent
Nutt

(10) Patent No.: US 7,466,085 B2
(45) Date of Patent: Dec. 16, 2008

(54) CYCLOTRON HAVING PERMANENT MAGNETS

(75) Inventor: Ronald Nutt, Knoxville, TN (US)

(73) Assignee: Advanced Biomarker Technologies, LLC, Knoxville, TN (US)

( * ) Notice: Subject to any disclaimer, the term of this patent is extended or adjusted under 35 U.S.C. 154(b) by 0 days.

(21) Appl. No.: 11/736,032

(22) Filed: Apr. 17, 2007

(65) Prior Publication Data

US 2008/0258653 A1 Oct. 23, 2008

(51) Int. Cl.
*H05H 13/00* (2006.01)

(52) U.S. Cl. ..... 315/502; 315/501; 250/291; 250/423 R; 313/62; 376/190

(58) Field of Classification Search ..... 315/500–502, 315/505, 507; 250/291, 427, 423 R, 423 F, 250/396 R, 492.1, 492.3, 492.21, 400; 313/62, 313/153, 359.1, 360.1, 362.1; 376/190, 192, 376/194, 196, 156, 158, 361
See application file for complete search history.

(56) References Cited

U.S. PATENT DOCUMENTS

| | | | | |
|---|---|---|---|---|
| 1,948,384 | A | 2/1934 | Lawrence | |
| 4,206,383 | A | 6/1980 | Anicich et al. | |
| 4,457,972 | A * | 7/1984 | Griffith et al. | 428/334 |
| 4,639,348 | A | 1/1987 | Jarnagin | |
| 5,037,602 | A * | 8/1991 | Dabiri et al. | 376/198 |
| 5,463,291 | A | 10/1995 | Carroll et al. | |
| 5,818,170 | A | 10/1998 | Kikunaga et al. | |
| 5,898,178 | A * | 4/1999 | Bunker | 250/423 R |
| 6,060,833 | A | 5/2000 | Velazco | |
| 6,163,006 | A | 12/2000 | Doughty et al. | |
| 6,239,541 | B1 * | 5/2001 | Fujisawa | 313/359.1 |
| 6,396,024 | B1 | 5/2002 | Doughty et al. | |
| 6,523,338 | B1 | 2/2003 | Kornfeld et al. | |
| 6,683,426 | B1 * | 1/2004 | Kleeven | 315/502 |
| 2004/0046116 | A1 | 3/2004 | Schroeder et al. | |
| 2005/0232387 | A1 * | 10/2005 | Padgett et al. | 376/194 |
| 2006/0049902 | A1 | 3/2006 | Kaufman | |

* cited by examiner

*Primary Examiner*—Haissa Philogene
(74) *Attorney, Agent, or Firm*—Pitts & Brittian, P.C.

(57) ABSTRACT

An apparatus for an improved cyclotron for producing radioisotopes especially for use in association with medical imaging. The improved cyclotron is configured without a conventional electromagnetic coil. A plurality of dees and a plurality of permanent magnets are alternately disposed in a circular array, each defining a channel through which ions travel. The vacuum chamber wall defines an opening disposed at the center of the array, the opening being configured to receive an ion source. Positive ions flowing from the ion source are exposed to the magnetic field generated by permanent magnets. The positive ions are repelled as they exit a positively charged dee. Negatively charged dees pull the ions. Each time the particles pass through the gap approaching the dees and as they leave the dee and pass through the magnets, they gain energy, so the orbital radius continuously increases and the particles follow an outwardly spiraling path. The disclosure also includes a system composed of a particle accelerator combined with a microreactor or microfluidic chip to produce molecular imaging biomarkers.

12 Claims, 5 Drawing Sheets

CYCLOTRON HAVING PERMANENT MAGNETS

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

The present invention pertains to the field of cyclotrons. More particularly, this invention is a cyclotron construction including permanent magnets.

2. Description of the Related Art

In the field of nuclear medicine, it is well known that cyclotrons are used for producing radiopharmaceuticals for use in imaging. Conventional cyclotrons employ a concept called "sector focusing" to constrain the vertical dimension of the accelerated particle beam within the poles of the cyclotron magnet. The magnet poles contain at least three wedge-shaped sectors, commonly known as "hills", where the magnetic flux is mostly concentrated. The hills are separated by regions, commonly referred to as "valleys", where the magnet gap is wider. As a consequence of the wider gap the flux density, or field strength, in the valleys is reduced compared to that in the hills.

Vertical focusing of the beam is enhanced by a large ratio of hill field to valley field; the higher the ratio, the stronger are the forces tending to confine the beam close to the median plane. In principle, a tighter confinement, in turn, reduces the required magnet gap without danger of the beam striking the pole faces in the magnet. For a given amount of flux in the gap, a magnet with a small gap requires less electrical power for excitation than does a magnet with a large gap.

In the limiting case of the "separated sector cyclotron" each hill sector is a complete, separate, stand-alone magnet with its own gap, poles, return/support yoke, and common excitation coil. In this implementation the valleys are merely large void spaces containing no magnet steel. Essentially all the magnetic flux is concentrated in the hills and almost none is in the valleys. In addition to providing tight vertical focusing, the separated-sector configuration allows convenient placement of accelerating electrodes and other apparatus in the large void spaces comprising the valleys.

More recently, superconducting magnet technology has been applied to cyclotrons. In superconducting cyclotron designs, the valleys are also large void spaces in which accelerating electrodes and other apparatus may be conveniently emplaced. The magnet excitation for a superconducting cyclotron is usually provided by a single pair of superconducting magnet coils which encircle the hills and valleys. A common return/support yoke surrounds the excitation coil and magnet poles.

To this extent, currently conventional cyclotrons consist of a plurality of hollow, semicircular metal electrodes $\mathbf{12}_P$, as illustrated in FIG. 1. These electrodes are commonly referred to as "dees" because of their shape. For simplicity, illustrated are two dees $\mathbf{12}_P$. However, there are typically four or more dees $\mathbf{12}_P$ used. As will be discussed below, ions are accelerated in a substantially circular, outwardly spiraling path. In devices using fewer dees $\mathbf{12}_P$, either more turns are required, or a higher acceleration voltage is required, or both, in order to energize the ions to the desired level. The dees $\mathbf{12}_P$ are positioned in the valley of the large electromagnet (not shown). Near the center of the dees $\mathbf{12}_P$ is an ion source $\mathbf{34}_P$ used for generating charged particles. The ion source $\mathbf{34}_P$ is typically an electrical arc device 50 in a gas.

During operation, ions are continuously generated by the ion source $\mathbf{34}_P$. A filament located in the ion source assembly creates both negative and positive ions through the addition of electrons or the subtraction of electrons. As the negative ions enter the vacuum tank $\mathbf{28}_P$, they gain energy due to a high-frequency alternating electric field induced on the dees $\mathbf{12}_P$. As the negative ions flow from the ion source $\mathbf{34}_P$, they are exposed to this electric field as well as a strong magnetic field generated by two magnet poles, one above and one below the vacuum tank $\mathbf{28}_P$. Because these are charged particles in a magnetic field, the negative ions move in a circular path.

When the negative ions reach the edge of the dee $\mathbf{12}_P$ and enter the gap, the RF oscillator changes the polarities on the dees $\mathbf{12}_P$. The negative ions are repelled as they exit the previously positive but now negatively charged dee $\mathbf{12}_P$. Each time the particles cross the gap they gain energy, so the orbital radius continuously increases and the particles follow an outwardly spiraling path. The particles are pushed from the first dee $\mathbf{12}_P$ and drift along a circular path until they are attracted or pulled by the second dee $\mathbf{12}_P$ which has become positively charged. The result is a stream of negative ions which are accelerated in a circular path spiraling outward.

Cyclotrons that are typical of the art are those devices disclosed in the following U.S. patents:

| U.S. Pat. No. | Inventor(s) | Issue Date |
|---|---|---|
| 1,948,384 | E. O. Lawrence | Feb. 20, 1934 |
| 4,206,383 | V. G. Anicich et al. | Jun. 3, 1980 |
| 4,639,348 | W. S. Jarnagin | Jan. 27, 1987 |
| 5,463,291 | L. Carroll et al. | Oct. 31, 1995 |
| 5,818,170 | T. Kikunaga et al. | Oct. 6, 1998 |
| 6,060,833 | J. E. Velazco | May 9, 2000 |
| 6,163,006 | F. C. Doughty et al. | Dec. 19, 2000 |
| 6,396,024 | F. C. Doughty et al. | May 28, 2002 |
| 6,523,338 | G. Kornfeld et al. | Feb. 25, 2003 |
| 2004/0046116 | J. B. Schroeder et al. | Mar. 11, 2004 |
| 2006/0049902 | L. Kaufman | Mar. 9, 2006 |

Of these patents, Lawrence, in his '384 patent, discloses a method and apparatus for the acceleration of ions. The Lawrence patent is based primarily upon the cumulative action of a succession of accelerating impulses, each requiring only a moderate voltage, but eventually resulting in an ion speed corresponding to a much higher voltage. According to Lawrence, this is accomplished by causing ions or electrically charged particles to pass repeatedly through accelerating electric fields in such a manner that the motion of the ion or charged particle is in resonance or synchronism with oscillations in the electric accelerating field or fields.

Anicich et al., in their '383 patent, disclose a miniaturized ion source device in an air gap of a small permanent magnet with a substantially uniform field in the air gap of about 0.5 inch. The device and permanent magnet are placed in an enclosure which is maintained at a high vacuum (typically $10^{-7}$ torr) into which a sample gas can be introduced. The ion-beam end of the device is placed very close to an aperture through which an ion beam can exit into apparatus for an experiment.

Jarnagin, in his '348 patent, discloses a re-circulating plasma fusion system. The '348 patent claims to include a plurality of recyclotrons, each comprising cyclotron means for receiving and accelerating charged particles in spiral and work conservative pathways, and output means for forming a beam from particles received. The cyclotron means used by Jarnagin includes a channel shaped electromagnet having a pair of indented polefaces oriented along an input axis and defining an input magnetic well. The cyclotron further includes a pair of elongated linear electrodes centered along the input magnetic well arranged generally parallel to the input axis and having a gap therebetween. A tuned oscillator means is connected to the electrodes for applying an oscillating electric potential thereto. The output means includes an inverter means including an electromagnet having a polarity opposite that of the channel shaped electromagnet oriented contigously therealong for extracting fully accelerated particles from the cyclotron means. A reinverter means includes an electromagnet having a polarity the same as that of the channel shaped electromagnet for correcting the flight path of the extracted particles, the inverter means and the reinverter means defining an output axis, along which the output means directs the beam. The recyclotrons are arranged so that particles of the output beam are received by the input magnetic well of an opposing similar recyclotron.

Carroll, et al., in their '291 patent, disclose a cyclotron and associated magnet coil and coil fabricating process. The cyclotron includes a return yoke defining a cavity therein. A plurality of wedge-shaped regions called "hills" are disposed in the return yoke, and voids called "valleys" are defined between the hills. A single, substantially circular magnet coil surrounds and axially spans the hills and the valleys.

In the '170 patent, Kikunaga et al., disclose a gyrotron system including an electron gun that produces an electron beam. A magnetic field generating unit comprises a permanent magnet and two electromagnets, and is capable of generating an axial magnetic field that drives electrons emitted from the electron gun for revolving motion. A cavity resonator causes cyclotron resonance maser interaction between the revolving electrons and a high-frequency electromagnetic field resonating in a natural mode. A collector collects the electron beam that has traveled through the cavity resonator. An output window is provided, through which a high-frequency wave produced by the cyclotron resonance maser interaction propagates.

Velazco, in the '833 patent, discloses an electron beam accelerator utilizing a single microwave resonator holding a transverse-magnetic circularly polarized electromagnetic mode and a charged-particle beam immersed in an axial focusing magnetic field.

In their '006 patent, Doughty et al., disclose a plasma-producing device wherein an optimized magnet field for electron cyclotron resonance plasma generation is provided by a shaped pole piece.

In their '024 patent, Doughty et al., disclose a method and apparatus for integrating multipolar confinement with permanent magnetic electron cyclotron resonance plasma sources to produce highly uniform plasma processing for use in semiconductor fabrication and related fields. The plasma processing apparatus includes a vacuum chamber, a workpiece stage within the chamber, a permanent magnet electron cyclotron resonance plasma source directed at said chamber, and a system of permanent magnets for plasma confinement about the periphery of the chamber.

Kornfeld et al., in the '338 patent, disclose a plasma accelerator arrangement in particular for use as an ion thruster in a spacecraft. A structure is proposed in connection with which an accelerated electron beam is admitted into an ionization chamber with fuel gas, and is guided through the ionization chamber in the form of a focused beam against an electric deceleration field, said electric deceleration field acting at the same time as an acceleration field for the fuel ions produced by ionization.

In Published Application No. 2004/0046116, Schroeder et al., disclose a negative ion source placed inside a negatively-charged high voltage terminal for emitting a beam which is accelerated to moderate energy and filtered by a momentum analyzer to remove unwanted ions. Reference ions such as carbon-12 are deflected and measured in an off-axis Faraday cup. Ions of interest, such as carbon ions of mass 14, are accelerated through 300 kV to ground potential and passed through a gas stripper where the ions undergo charge exchange and molecular destruction. The desired isotope, carbon-14 along with fragments of the interfering molecular ions, emerges from the stripper into a momentum analyzer which removes undesirable isotope ions. The ions are further filtered by passing through an electrostatic spherical analyzer to remove ions which have undergone charge exchange. The ions remaining after the spherical analyzer are transmitted to a detector and counted.

In Published Application No. 2006/0049902, Kaufman defines a plurality of permanent magnets to enhance radiation dose delivery of a high energy particle beam. The direction of the magnetic field from the permanent magnets may be changed by moving the permanent magnets.

BRIEF SUMMARY OF THE INVENTION

The present invention is an improved cyclotron for producing radioisotopes especially for use in association with medical imaging. The improved cyclotron is configured without the inclusion of a conventional electromagnetic coil of the cyclotron. Accordingly, the weight and size of the present invention is substantially reduced as compared to conventional cyclotrons. Further, the electric power needed to excite the conventional cyclotron magnet is eliminated, thereby substantially reducing the power consumption of the improved cyclotron.

The improved cyclotron includes an upper platform and a lower platform. Each of the upper and lower platforms defines a recess on the interior side thereof, such that as the upper and lower platforms are engaged, the recesses define a vacuum chamber. A circular array of permanent magnets is disposed within each of the recesses. A circular array of dees is disposed within the vacuum chamber, with one dee being disposed between corresponding pairs of permanent magnets in alternating fashion.

Each dee defines a proximal end oriented toward the center of the array and an oppositely disposed distal end. Likewise, each permanent magnet defines a proximal end oriented proximate the center of the array, and an oppositely disposed distal end. Each of the dees is positioned in a valley between the permanent magnets and defines a channel through which ions travel as they are accelerated by the improved cyclotron. When the upper and lower platforms are engaged, a gap is defined between corresponding permanent magnets of the upper and lower platforms such that a substantially homogeneous height channel is defined around the entirety of the vacuum chamber to define an unobstructed flight path for the ions being accelerated therein.

A centrally disposed opening is defined in the upper and lower platforms for the introduction of an ion source. The ion source opening is disposed such that an ion source may be introduced at the center point of the circular array of alternating dees and permanent magnets. Upon the excitation of an ion from the ion source, selected ions are introduced into a first channel defined in the proximal end of a first dee. The channel defines an outlet into the gap between corresponding permanent magnets carried by the upper and lower platforms. A second channel is defined within the proximal end of a second dee. Similarly, a third channel is defined with the proximal end of a third dee. The first, second and third channels are configured to define the first revolution of selected ions through the vacuum chamber. Ions excited which are not at the desired initial energy level and polarity are rejected by not allowing such ions to enter the first channel. After exiting the third channel, the ions traverse through the channel defined by each of the dees until the desired energy level is accomplished.

Each of the dees is subjected to an oscillating voltage such that the polarity of each oscillates. As a result, as an ion approaches the dee, the energy level is predictably increased, as are the speed and radius of travel. Upon exiting a dee the ion is further accelerated and the ions drift through the magnetic field created between corresponding permanent magnets. Upon attaining the desired energy level, ions collide with a target placed in the path of the ion. An oscillator is provided in connection with each of the dees for oscillating the polarity of each in order to accomplish the acceleration of the ion stream. A dee support is electrically connected between each of the dees and the oscillator.

During operation, ions are continuously generated by the ion source. A filament located in the ion source assembly creates ions which include both positively charged ions and negatively charged ions. As the positive ions enter the vacuum chamber, they gain energy due to a negatively charged alternating electric field induced on the dees. As the positive ions flow from the ion source, they are exposed to the magnetic field generated by the array of permanent magnets. Because these are charged particles in a magnetic field, the positive ions move in roughly a circular path. The positive ions are attracted as they enter a negatively charged dee. As the ions exit, the dee is positively charged, and the ions are repelled by such dee. Each time the particles pass through the gap approaching the dees and as they leave the dee and pass through the magnets, they gain energy, so the orbital radius continuously increases and the particles follow an outwardly spiraling path.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

An improved cyclotron for producing radioisotopes especially for use in association with medical imaging is disclosed. The improved cyclotron is configured such that the conventional electromagnetic coil is obviated. Accordingly, the weight and size of the present invention is substantially reduced as compared to conventional cyclotrons. Also, the electric power needed to excite the conventional cyclotron magnet is eliminated.

Figure 1:
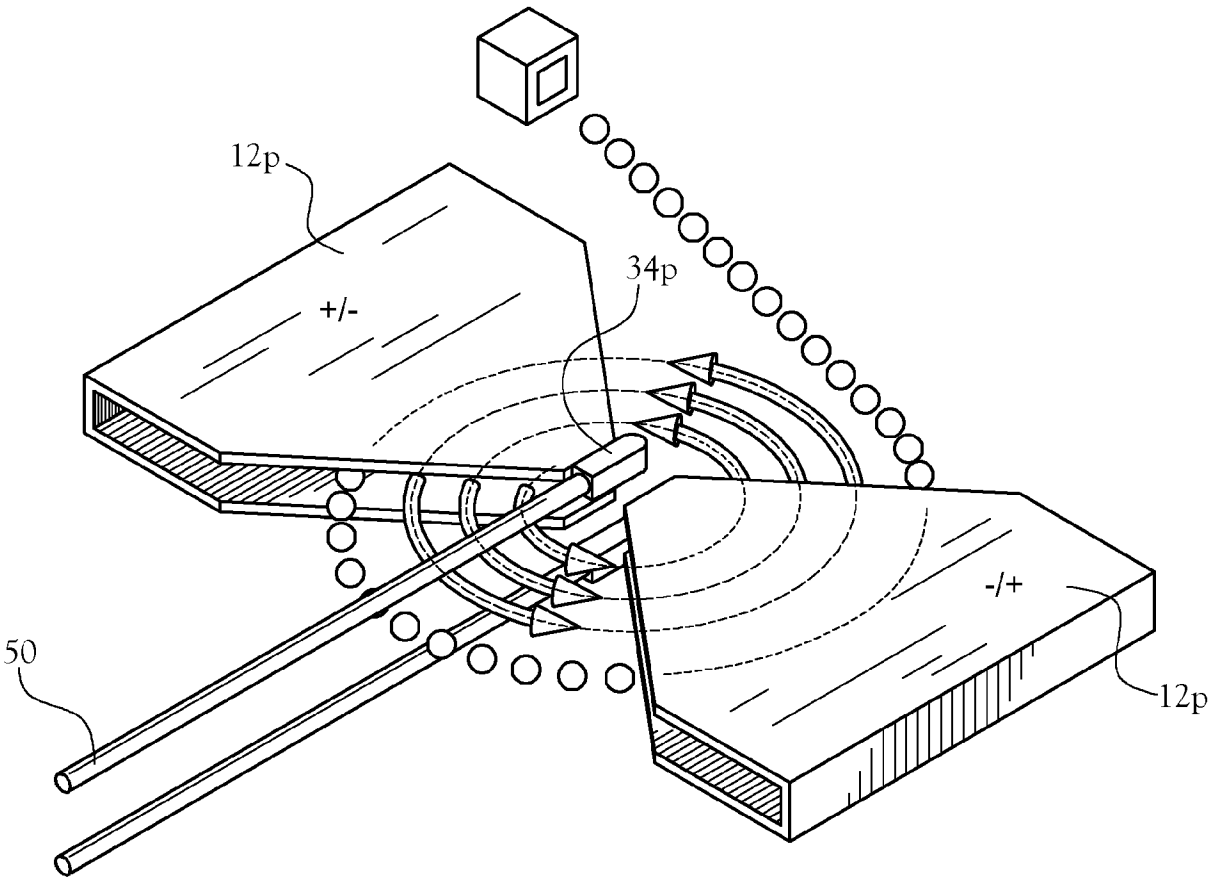
Fig. 1 (PRIOR ART)
FIG. 1 is a perspective view of the ionization and acceleration components disposed within a conventional cyclotron.
Figure 2:
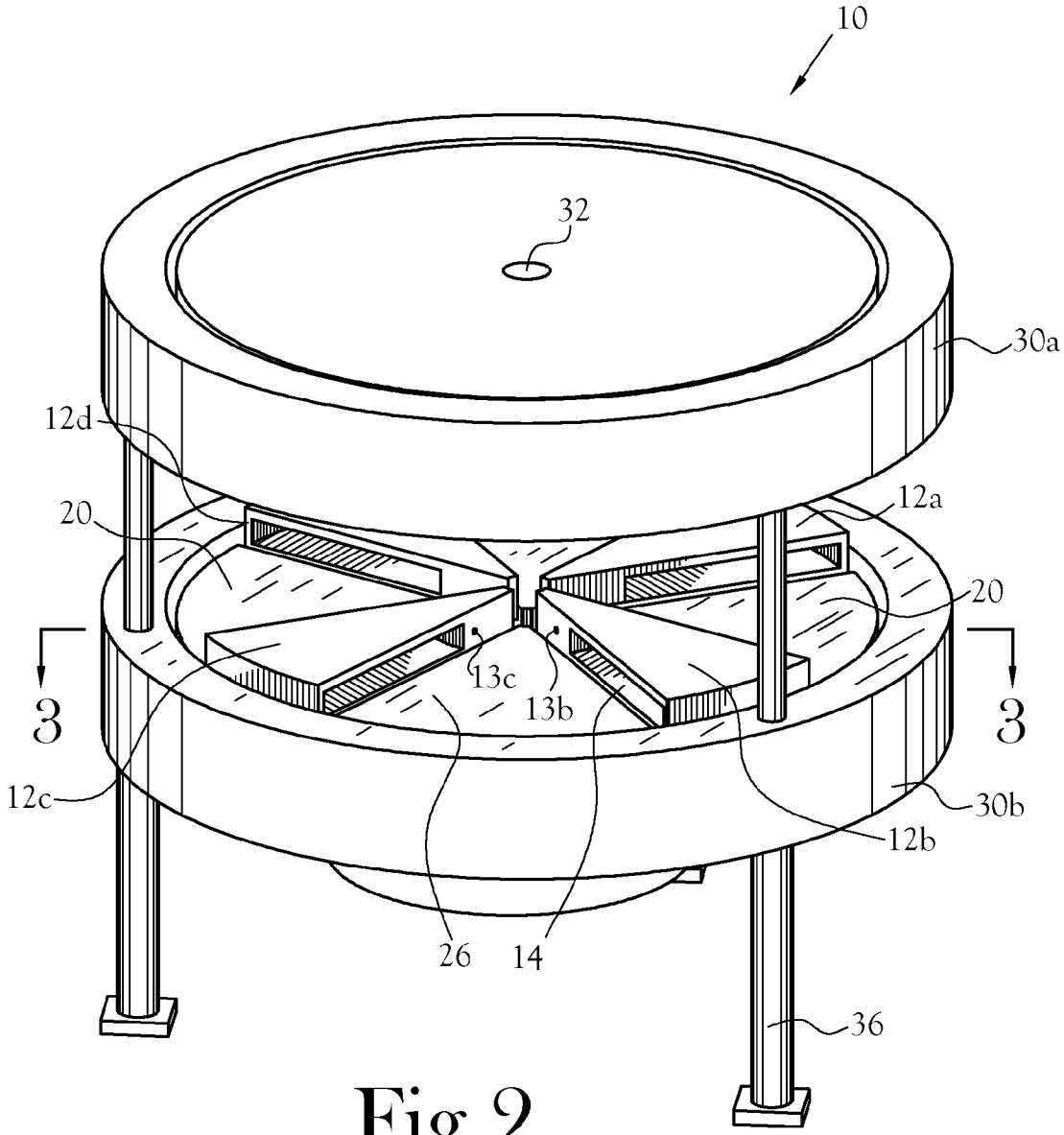
FIG. 2 is a perspective view of the improved cyclotron of the present invention, showing an upper platform disposed above a lower platform in an open orientation, the improved cyclotron constructed in accordance with several features of the present invention.
Figure 2A:
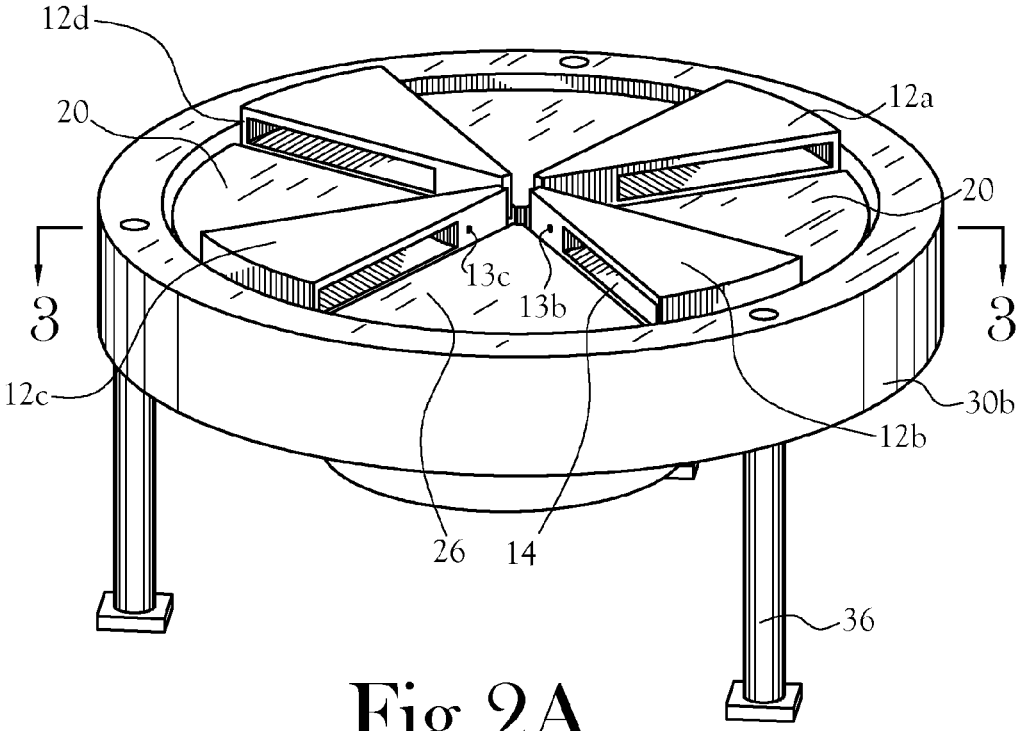
FIG. 2A is a perspective view of the lower platform of the improved cyclotron of the present invention, constructed in accordance with several features of the present invention.

FIGS. 2 and 2A illustrate the primary components of the improved cyclotron 10 of the present invention. Generally, the improved cyclotron 10 includes an upper platform 30*a* and a lower platform 30*b*. The lower platform 30*b* is more clearly illustrated in FIG. 2A. Each of the upper and lower platforms 30*a,b* defines a recess 31 on the interior side thereof, such that as the upper and lower platforms 30*a,b* are engaged, the recesses 31*a,b* define a vacuum chamber 28. A circular array of permanent magnets 20 is disposed within each of the recesses 31. Between respective pairs of the permanent magnets 20 are "valleys". A circular array of dees 12 is disposed within the vacuum chamber 28, with one dee 12 being disposed in each valley between corresponding pairs of the permanent magnets 20, i.e., a permanent magnet 20 carried by the upper platform 30*a* and a corresponding permanent magnet carried by the lower platform 30*b*, in alternating fashion. In the illustrated embodiment, each of the permanent magnets 20 and the dees 12 define a wedge-shaped configuration.

Each dee 12 defines a proximal end 16 oriented toward the center of the array and an oppositely disposed distal end 18. Likewise, each permanent magnet 20 defines a proximal end 24 oriented proximate the center of the array, and an oppositely disposed distal end 26. Each of the dees 12 defines a channel 14 through which ions travel as they are accelerated by the improved cyclotron 10. When the dees 12 are disposed with the vacuum chamber 28, the top surface of the permanent magnets 20 is disposed in substantially the same plane as a side wall of the dee channel 14. When the upper and lower platforms 30*a,b* are engaged, a gap 22 is defined between corresponding permanent magnets 20 of the upper and lower platforms 30*a,b*. Accordingly, a substantially homogeneous height channel 14,22 is defined around the entirety of the vacuum chamber 28 to define an unobstructed flight path for the ions being accelerated therein.

A centrally disposed opening 32 is defined in the upper and lower platforms 30*a,b* for the introduction of an ion source 34. The ion source opening 32 is disposed such that an ion source 34 may be introduced at the center point of the circular array of alternating dees 12 and permanent magnets 20.

Illustrated is a plurality of legs 36 disposed under the lower platform 30*b*. In this embodiment, each leg 36 is defined by the cylinder body 38 of a pneumatic or hydraulic cylinder. The lower platform 30*b* defines a plurality of through openings 35 for slidably receiving a piston rod 40 of each of the cylinders 36. A distal end 42 of each piston rod 40 is connected to the upper platform 30*a*. Thus, engagement of the upper and lower platforms 30*a,b* is accomplished by retraction of the piston rods 42 into the respective cylinders 40. Separation of the upper and lower platforms 30*a,b* is accomplished in part by extending the piston rods 42 from within the cylinders 40. While this construction is disclosed, it will be understood that other configurations are contemplated as well.

Figure 3:
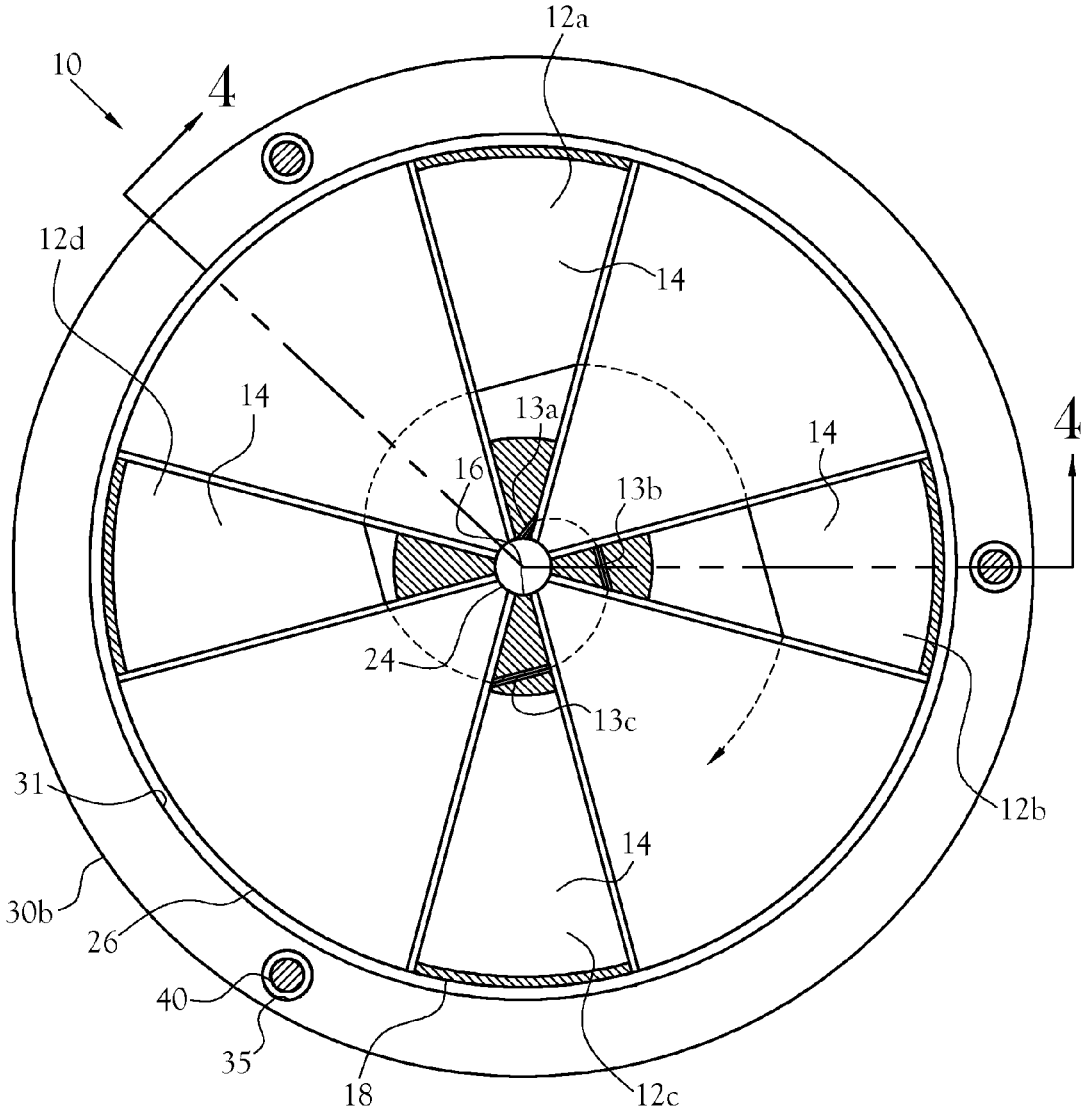
FIG. 3 is a plan view of the lower platform and a cross-sectional view, taken along lines 3-3 of FIG. 2, showing of each of the dees in cross-section and illustrating the flight path of ions accelerated through the improved cyclotron of FIG. 2.

Referring to FIG. 3, the flight path of an ion is more clearly illustrated. Upon the excitation of an ion from the ion source 34, selected ions are introduced into a first collimator channel 13*a* defined in the proximal end 16 of a first dee 12*a*. The first collimator channel 13*a* defines an outlet into the gap 22 between corresponding permanent magnets 20 carried by the upper and lower platforms 30*a,b*. A second collimator channel 13*b* is defined within the proximal end 16 of the second dee 12*b*. Similarly, a third collimator channel 13*c* is defined with the proximal end 16 of the third dee 12*c*. The first, second and third collimator channels 13*a,b,c* are configured to define the first revolution of selected ions through the vacuum chamber 28. Ions excited which are not at the desired initial energy level are rejected by not allowing such ions to enter the first collimator channel 13*a*. After exiting the third collimator channel 13*c*, the ions traverse through the channels 14 defined by each of the dees 12 until the desired energy level is accomplished.

As will be discussed below, each of the dees 12 is subjected to an oscillating voltage such that the polarity of each oscillates. In the illustrated embodiment, a target acceleration voltage of approximately 20 killovolts or less is applied to the dees 12. As a result, as an ion approaches the dee 12, and as it leaves the dee 12, the energy level is predictably increased. Likewise, the speed is increased, as well as the radius of travel. Upon exiting a dee 12, the ions drift through the magnetic field created between corresponding permanent magnets 20. Because the ions are traveling in a magnetic field, their travel path is substantially circular. Upon attaining the desired energy level, ions are withdrawn from the improved cyclotron 10.

Figure 4:
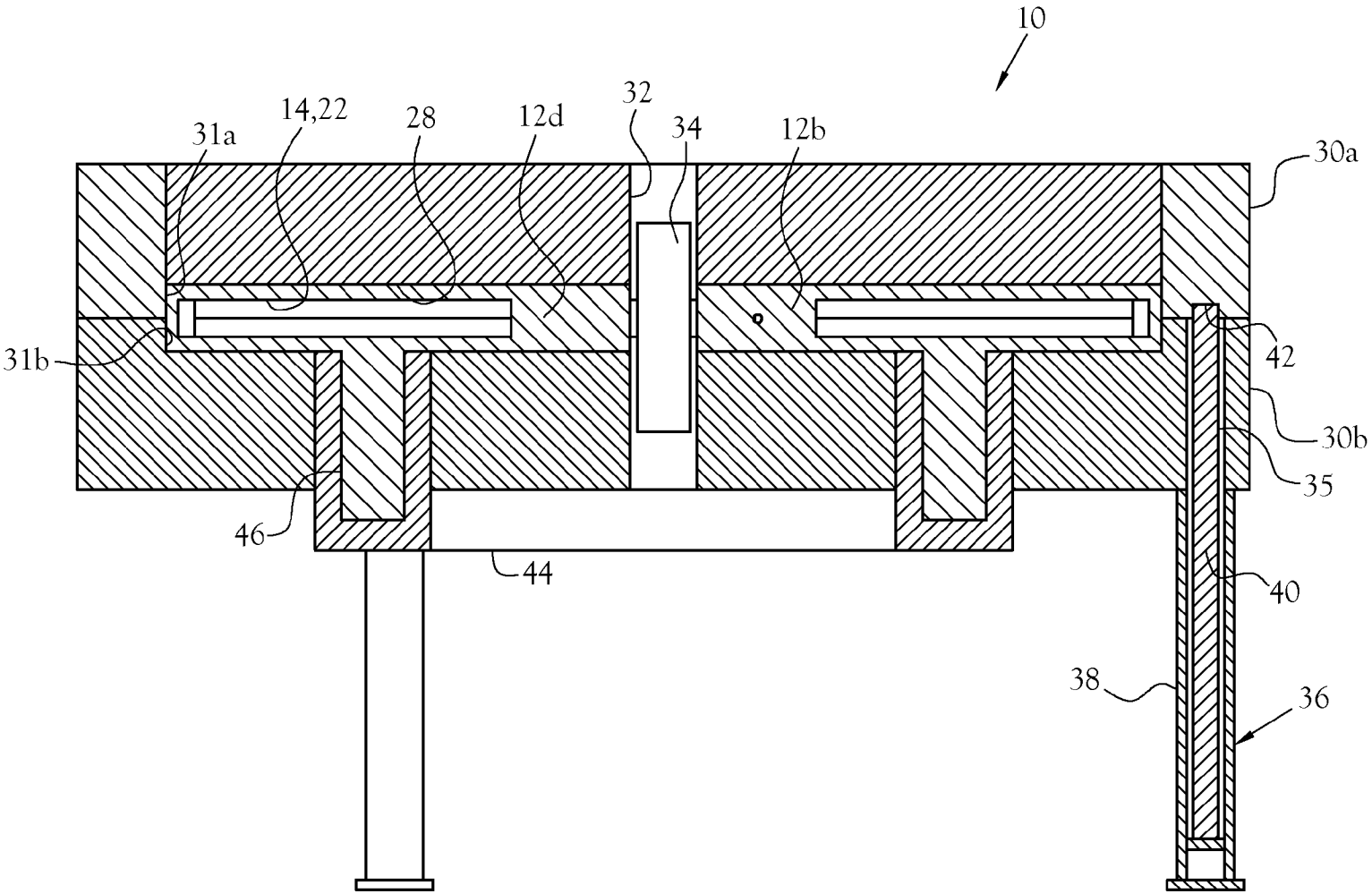
FIG. 4 is an elevation view, in cross-section taken along lines 4-4 of FIG. 3, of the improved cyclotron of FIG. 2 illustrating the upper platform engaged with the lower platform.

Illustrated in FIG. 4 is a cross-sectional view of the improved cyclotron 10 of the present invention shown with the upper and lower platforms 30*a,b* engaged with one another. Each dee 12 defines a channel 14 through which ions travel. Cooperatively, each of the permanent magnets 20 defines a channel 22 through which the ions travel. As an ion passes through a dee 12, it is accelerated. The ion then drifts through the magnet channel 22. As the ion exits the magnet channel 22, it is accelerated toward and through the next dee 12.

An oscillator 44 is shown schematically in connection with each of the dees 12. The oscillator 44 is adapted to induce a negatively charged alternating electric field on the dees 12, whereby positive ions generated from an ion source 34 are accelerated within the improved cyclotron 10. The oscillator 44 is provided for oscillating the polarity of each of the dees 12 in order to accomplish the acceleration of the ion stream. To this extent, the lower platform 30*b* defines a plurality of through openings 48. A dee support 46 is electrically connected to each of the dees 12, and is configured and disposed to be received within one of plurality of through openings 48. The dee supports 46 are further electrically connected to the oscillator 44, thereby establishing electrical communication between the oscillator 44 and each of the dees 12. Also illustrated schematically is the ion source 34 received within the central opening 32 defined by the upper and lower platforms 30*a,b*.

During operation, ions are continuously generated by the ion source 34. The ions gain energy due to a negatively charged alternating electric field induced on the dees 12. As the positive ions flow from the ion source 34, they are exposed to the magnetic field generated by the array of permanent magnets 20. The ions are repelled as they exit a dee 12. As the ions approach a dee 12, they are pulled by such dee 12. Each time the particles pass through the gap approaching the dees 12 and as they leave the dee 12 and pass through the magnets 20, they gain energy, so the orbital radius continuously increases and the particles follow an outwardly spiraling path. To this extent, the positive ions are attracted to a negatively charged dee 12. As the ions exit the dee 12, the dee 12 is then positively charged as a result of the alternating electric field, and is therefore repelled from such dee 12. The ions drift along a roughly circular path through the permanent magnets 20 until they are attracted by the next dee 12. The result is a stream of ions which are accelerated in a substantially circular path spiraling outward.

It will be recognized by those skilled in the art that that the improved cyclotron 10 of the present invention provides substantial improvements with respect to cost and reliability in low-power cyclotrons of accelerated energy of 8-10 MeV, or less. While the improved cyclotron 10 is presently not practical for higher acceleration voltages due to the increased magnetic field requirements of the permanent magnets 20, such embodiments are not excluded from the spirit of the present invention.

Because the present invention allows for the exclusion of the electromagnetic coils of the prior art, the volume of the device is reduced, in one embodiment, by approximately forty percent (40%), with a minimum equipment cost savings of twenty-five percent (25%). Similarly, without the coils, the weight is reduced by approximately forty percent (40%). A significant savings in energy is achieved by eliminating the coils. Energy requirements are further reduced as a result of the lower acceleration voltage of 8-10 MeV or less applied to the dees 12. As a result of these improvements, the reliability of the improved cyclotron 10 is enhanced as compared to cyclotrons of the prior art. As a result of the smaller size and lighter weight, more facilities are capable of operating the present invention, especially in situations where space is of concern. Further, because of the ultimately reduced purchase and operating costs, the improved cyclotron of the present invention is also more affordable.

The target incorporated in the present invention is internal to the improved cyclotron 10, allowing bombardment of ions where the reaction occurs. Further, as a result of the target being internal, there is no radiation exposure due to the extraction mechanism. To further such improvement, the permanent magnets 20 further serve as a radiation shield around the target where most of the radiation is generated, thereby further reducing costs. Because the improved cyclotron 10 is capable of using highly stable positive ions, the vacuum requirements are reduced and the reliability is increased while, again, the cost is reduced. To wit, with respect to the use of positive ions, positive ions are more stable than negative ions, thus lending to the improved reliability of their use. Positive ions require less vacuum as compared to negative ions, thereby requiring less expensive pumps, which enhances both the cost and reliability concerns of the improved cyclotron 10. Positive ions are also easier to generate within the source again decreases the complexity and cost of the ion source.

In one application of the present invention, the improved cyclotron 10 is incorporated in a system for producing a radiochemical, the system also including a radiochemical synthesis subsystem having at least one microreactor and/or microfluidic chip. This is set forth in copending U.S. application Ser. No. 11/441,999, filed May 26, 2006 and entitled "Biomarker Generator System." The disclosure of this application in incorporated herein by reference. The radiochemical synthesis subsystem is provided for receiving the radioactive substance, for receiving at least one reagent, and for synthesizing the radiochemical comprising. In this application, the improved cyclotron 10 generates a beam of charged particles having a maximum beam power of less than, or equal to, approximately fifty (50) watts.

From the foregoing description, it will be recognized by those skilled in the art that an improved cyclotron has been provided. The improved cyclotron is provided with an acceleration device including an array of electrodes in the form of dees, and an interposed array of permanent magnets. An ion source is carried within at least one wall of the vacuum chamber for releasing ions into the cyclotron stream. Accordingly, the conventional magnetic coils used in conventional cyclotrons are eliminated, thereby reducing equipment and operating costs, as well as reducing size and increasing operability.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

Having thus described the aforementioned invention, I claim:

1. An improved cyclotron for producing radioisotopes especially for use in association with medical imaging, the improvement comprising:

a first platform defining a first recess;

a first plurality of permanent magnets disposed in a circular array within said first recess;

a second platform defining a second recess;

a second plurality of permanent magnets disposed in a circular array within said second recess and corresponding to said first plurality of permanent magnets to define a plurality of permanent magnet pairs when said first platform and said second platform are engaged, wherein each of said plurality of permanent magnet pairs defines a gap between one of said first plurality of permanent magnets and one of said second plurality of permanent magnets;

a vacuum chamber defined by said first recess and said second recess when said first platform and said second platform are engaged;

a plurality of dees disposed within said vacuum chamber, one of said plurality of dees being disposed between pairs of said plurality of permanent magnet pairs, each of said plurality of dees defining a proximal end oriented toward a center of said circular array and an oppositely disposed distal end, wherein each of said plurality of dees defines an interior channel, and wherein said gap defined between each of said plurality of permanent magnet pairs being adapted to cooperate with said interior channel of each of said plurality of dees to define a volume through which ions generated by said an source travel, whereby said ions are accelerated through said interior channel of each of said plurality of dees and drift through said interior channel of each of said plurality of permanent magnets; and an oscillator in electrical connection with and in order to oscillate a polarity of each of said plurality of dees.

2. The improved cyclotron of claim 1 wherein said first platform and said second platform cooperate to define a receptor adapted to receive said ion source such that said ion source is disposed at an approximate center of said circular array.

3. The improved cyclotron of claim 2 wherein said oscillator is adapted to induce a negatively charged alternating electric field on said plurality of dees, whereby positive ions generated from said ion source are accelerated within said improved cyclotron.

4. An improved cyclotron for producing radioisotopes especially for use in association with medical imaging, the improvement comprising:

a first platform defining a first recess;

a first plurality of permanent magnets disposed in a circular array within said first recess;

a second platform defining a second recess, said first platform and said second platform cooperating to define a receptor adapted to receive an ion source such that said ion source is disposed at an approximate center of said circular array;

a second plurality of permanent magnets disposed in a circular array within said second recess and corresponding to said first plurality of permanent magnets to define a plurality of permanent magnet pairs when said first platform and said second platform are engaged, wherein each of said plurality of permanent magnet pairs defines a gap between one of said first plurality of permanent magnets and one of said second plurality of permanent magnets;

a vacuum chamber defined by said first recess and said second recess when said first platform and said second platform are engaged;

a plurality of electrodes disposed within said vacuum chamber, one of said plurality of electrodes being disposed between pairs of said plurality of permanent magnet pairs, each of said plurality of electrodes defining a proximal end oriented toward a center of said circular array and an oppositely disposed distal end, wherein each of said plurality of electrodes defines an interior channel, and wherein said gap defined between each of said plurality of permanent magnet pairs is adapted to cooperate with said interior channel of each of said plurality of electrodes to define volume through which ions generated by said ion source travel, whereby said ions are accelerated through said interior channel of each of said plurality of electrodes and drift though said interior channel of each of said plurality of permanent magnets; and an oscillator in electrical connection with and in order to oscillate a polarity of each of said plurality of electrodes.

5. The improved cyclotron of claim 4 wherein said oscillator is adapted to induce a negatively charged alternating electric field on said plurality of electrodes, whereby positive ions generated from said ion source are accelerated within said improved cyclotron.

6. The improved cyclotron of claim 4, wherein each of said plurality of electrodes is a dee.

7. An improved cyclotron for producing radioisotopes especially for use in association with medical imaging, the improvement comprising:

a first platform defining a first recess;

a first plurality of permanent magnets disposed in a circular array within said first recess;

a second platform defining a second recess;

a second plurality of permanent magnets disposed in a circular array within said second recess and corresponding to said first plurality of permanent magnets to define a plurality of permanent magnet pairs when said first platform and said second platform are engaged, wherein each of said plurality of permanent magnet pairs defines a gap between one of said first plurality of permanent magnets and one of said second plurality of permanent magnets;

a vacuum chamber defined by said first recess and said second recess when said first platform and said second platform are engaged;

a plurality of electrodes disposed within said vacuum chamber, each of said plurality of electrodes defining a dee, one of said plurality of electrodes being disposed between pairs of said plurality of permanent magnet pairs, each of said plurality of electrodes defining a proximal end oriented toward a center of said circular array and an oppositely disposed distal end, wherein each of said plurality of electrodes defines an interior channel, said gap defined between said one of said first plurality of permanent magnets and said one of said second plurality of permanent magnets being adapted to cooperate with said interior channel of each of said plurality of electrodes to define a volume through which ions travel, whereby said ions are accelerated through said interior channel of each of said plurality of electrodes and drift though said interior channel of each of said plurality of permanent magnets; and an oscillator in electrical connection with and in order to oscillate a polarity of each of said plurality of electrodes.

8. The improved cyclotron of claim 7 wherein said first platform and said second platform cooperate to define a receptor adapted to receive an ion source such that said ion source is disposed at an approximate center of said circular array.

9. The improved cyclotron of claim 8 wherein said oscillator is adapted to induce a negatively charged alternating electric field on said plurality of electrodes, whereby positive ions generated from said ion source are accelerated within said improved cyclotron.

10. A system for producing a radiochemical, said system comprising:

a particle accelerator for generating a beam of charged particles having a maximum beam power of less than, or equal to, approximately fifty (50) watts, and for directing the beam of charged particles along a path, said particle accelerator and system including:

a first platform defining a first recess;

a first plurality of permanent magnets disposed in a circular array within said first recess;

a second platform defining a second recess;

a second plurality of permanent magnets disposed in a circular array within said second recess and corresponding to said first plurality of permanent magnets to define a plurality of permanent magnet pairs when said first platform and said second platform are engaged, wherein each of said plurality of permanent magnet pairs defines a gap between one of said first plurality of permanent magnets and one of said second plurality of permanent magnets;

a vacuum chamber defined by said first recess and said second recess when said first platform and said second platform are engaged;

a plurality of dees disposed within said vacuum chamber, one of said plurality of dees being disposed between pairs of said plurality of permanent magnet pairs, each of said plurality of dees defining a proximal end oriented toward a center of said circular array and an oppositely disposed distal end, wherein each of said plurality of dees defines an interior channel, and wherein said gap defined between each of said plurality of permanent magnet pairs is adapted to cooperate with said interior channel of each of said plurality of dees to define a volume through which ions generated by an ion source travel, whereby said ions are accelerated through said interior channel of each of said plurality of dees and drift through said interior channel of each of said plurality of permanent magnets; and an oscillator in electrical connection with and in order to oscillate a polarity of each of said plurality of dees;

a target positioned in the path of the beam of charged particles, said target serving to receive a target substance having a composition selected for producing a radioactive substance during interaction with the beam of charged particles; and a radiochemical synthesis subsystem having at least one microreactor and/or microfluidic chip, said radiochemical synthesis subsystem for receiving the radioactive substance, for receiving at least one reagent, and for synthesizing the radiochemical.

11. The system of claim 10 wherein said first platform and said second platform cooperate to define a receptor adapted to receive an ion source such that said ion source is disposed at an approximate center of said circular array.

12. The system of claim 11 wherein said oscillator is adapted to induce a negatively charged alternating electric field on said plurality of dees, whereby positive ions generated from said ion source are accelerated within said improved cyclotron.

* * * * *